United States Patent [19]

Harrell

[11] 4,428,890

[45] Jan. 31, 1984

[54] CYLINDRICAL EVAPORATIVE COOLER APPARATUS

[75] Inventor: Robert L. Harrell, Phoenix, Ariz.

[73] Assignee: Hi-Lo Manufacturing, Inc., Avondale, Ariz.

[21] Appl. No.: 379,314

[22] Filed: May 18, 1982

[51] Int. Cl.[3] ..... B01F 3/04

[52] U.S. Cl. ..... 261/29; 261/106; 261/DIG. 41

[58] Field of Search ..... 261/DIG. 4, 29, DIG. 41, 261/106; D23/139; 220/356

[56] References Cited

U.S. PATENT DOCUMENTS

| | | | |
|---|---|---|---|
| D. 256,388 | 8/1980 | Harrell | D23/139 |
| 2,606,708 | 8/1952 | Irvan | 220/356 |
| 3,188,007 | 6/1965 | Myklebust | 261/29 |
| 4,026,971 | 5/1977 | Glasoe | 261/29 |
| 4,029,723 | 6/1977 | Morrison et al. | 261/29 |
| 4,043,777 | 8/1977 | Parren | 261/DIG. 4 |
| 4,264,007 | 4/1981 | Hunt | 220/23 |
| 4,309,365 | 1/1982 | Van Ness et al. | 261/DIG. 41 |
| 4,351,781 | 9/1982 | Blatter | 261/29 |

FOREIGN PATENT DOCUMENTS

| | | | |
|---|---|---|---|
| 539200 | 11/1931 | Fed. Rep. of Germany | 220/356 |

*Primary Examiner*—Tim R. Miles

*Attorney, Agent, or Firm*—H. Gordon Shields

[57] ABSTRACT

Cylindrical evaporator cooler apparatus includes a lower portion having a water sump, a water pump, and a support for a blower system, a vertically extending and cylindrical pad frame, and a top lid covering the pad frame which includes an integral trough through which water is fed to saturate the pads disclosed in the pad frame.

13 Claims, 13 Drawing Figures

FIG. 2A
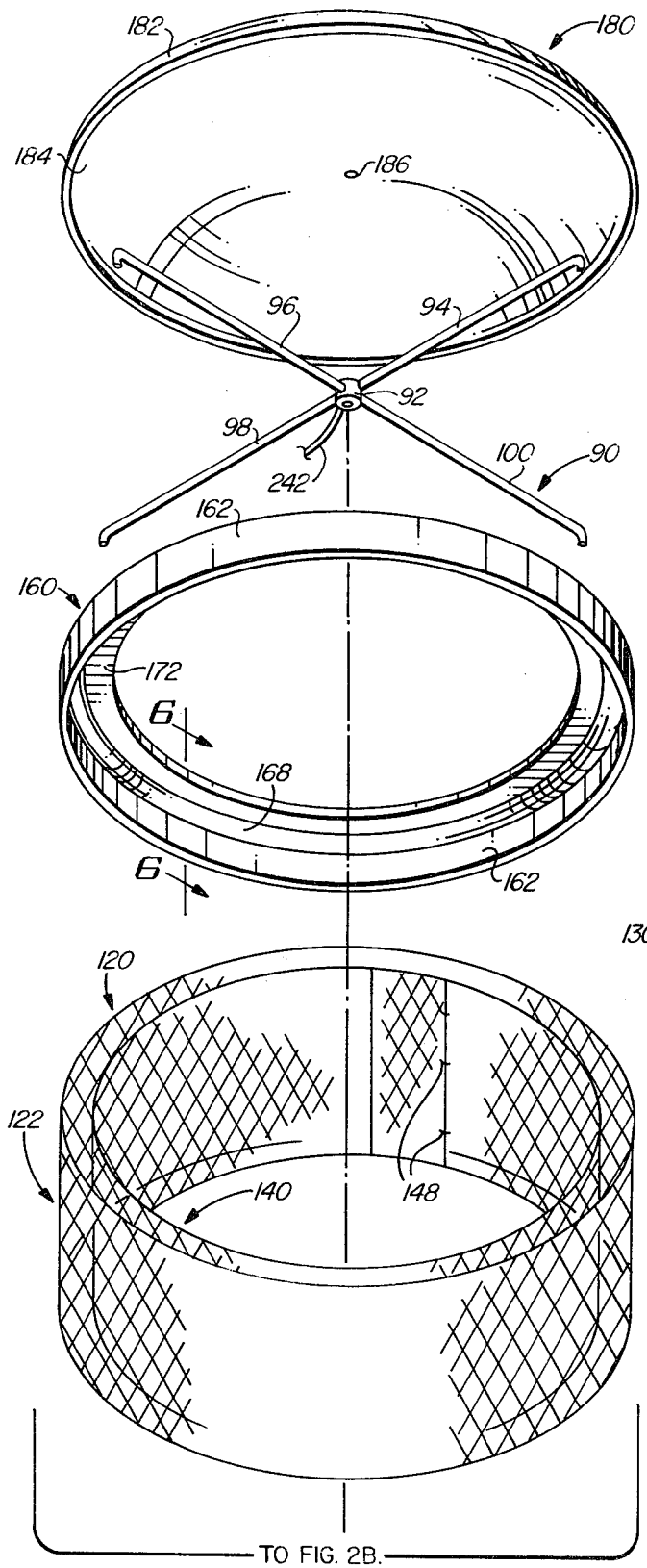
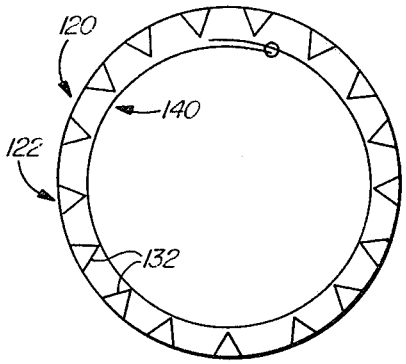
FIG. 3
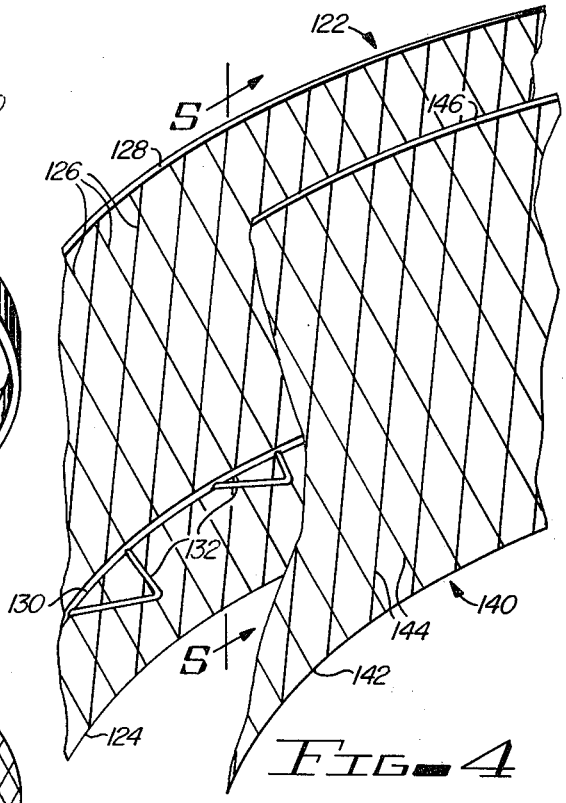
FIG. 4
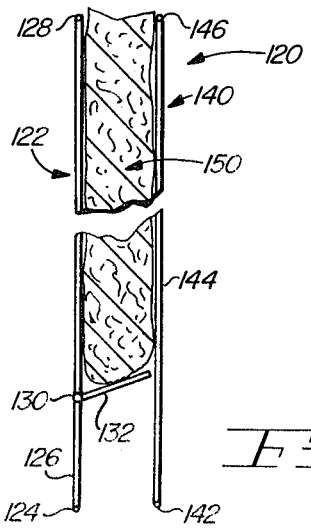
FIG. 5

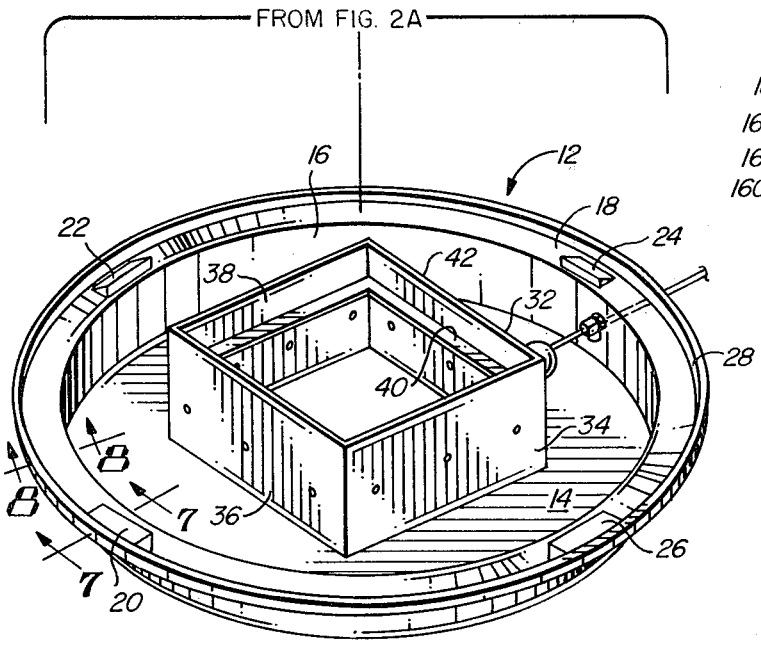
FIG. 2B
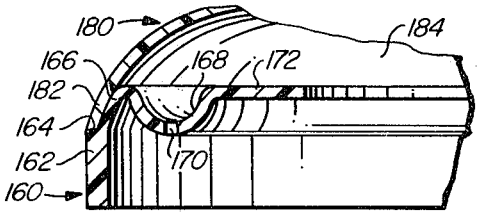
FIG. 6
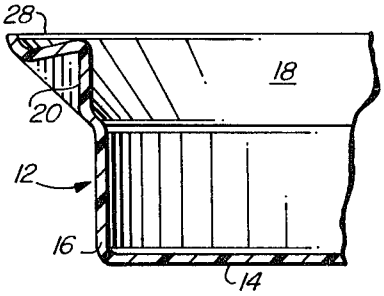
FIG. 7
FIG. 8
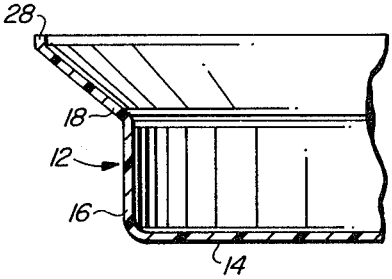
FIG. 9
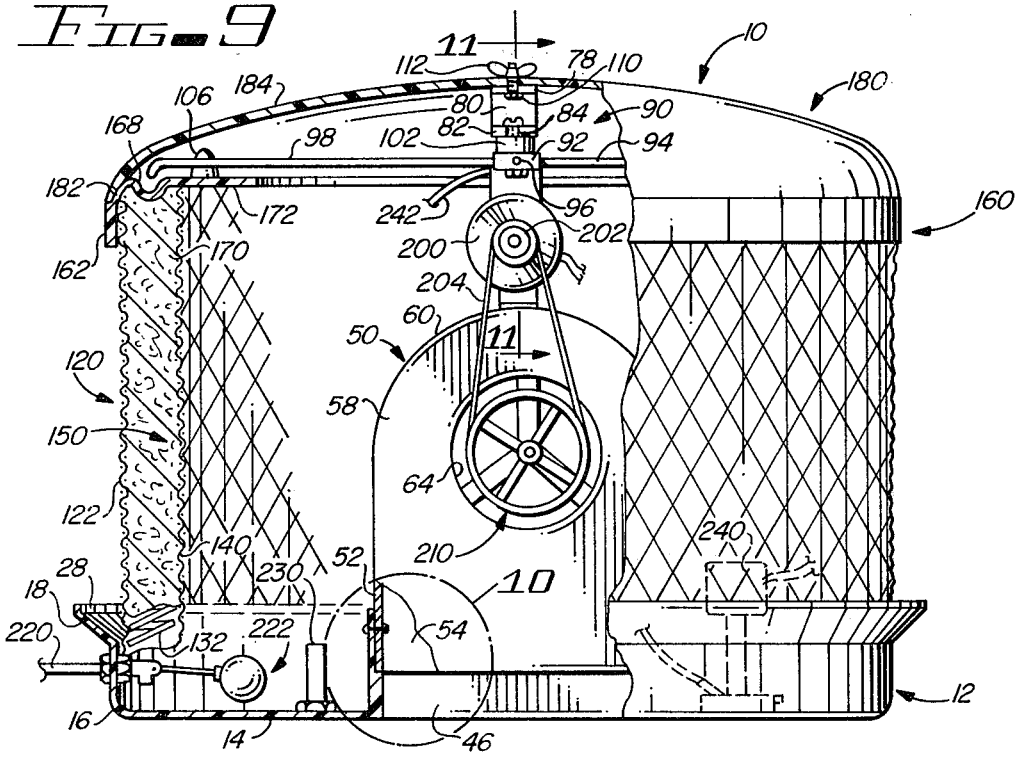

CYLINDRICAL EVAPORATIVE COOLER APPARATUS

BACKGROUND OF THE INVENTION

1. Field of the Invention

This invention relates to evaporative cooler apparatus, and, more particularly, to round or cylindrical evaporative cooler apparatus.

2. Description of the Prior Art

For cooling air in geographical areas of relatively low humidity, evaporative coolers are extensively used. The cooling principle of the evaporative cooler is that air is drawn into the cooler through pads soaked with water. The air gives up heat of vaporization to the water, thus cooling the air. The vaporized water flows with the cooled air and is distributed throughout the area of the structure, such as a building, a home, etc., that is to be cooled.

The temperature of the air may be lowered several degrees by an evaporative cooler system. The evaporatively cooled air is circulated throughout the building, etc., to replace or cool the warmer air within the structure. New or fresh air is continually brought into the evaporative cooler and is circulated throughout the structure, and then it flows out of the structure to return to the outside air.

Most evaporative air cooling systems of the prior art are generally of a rectangular configuration, having either three or four sides that contain pads and through which the incoming air flows. Within the rectangular housing is a blower which pulls the outside air into the evaporative cooler through the pads and circulates the cooled air through the structure on which the evaporative cooler is located. Typically, squirrel cage type blowers are used for air movement due to their flow capacities.

The evaporative cooler housings, as described above, are usually made of sheet metal. However, in recent years the use of round or cylindrical evaporative coolers, using fiberglass and resin rather than sheet metal, has been suggested. Examples of such coolers are shown in U.S. Pat. No. DES. 256,388, by the inventor of the present apparatus, and by U.S. Pat. No. 4,026,971.

The use of fiberglass impregnated with resin offers advantages not heretofore present with sheet metal evaporative cooler systems. For example, corrosion and rust are problems with sheet metal coolers. However, fiberglass coolers are impervious to corrosion and they do not rust. Accordingly, these two problems, which are major problems with respect to sheet metal coolers, are not present with fiberglass coolers, such as the present invention.

Aesthetically, a round, cylindrical cooler appears more pleasant to the eye than does a square or rectangular sheet metal cooler. Moreover, a round cooler may use a continuous pad extending virtually 360° while a square or rectangular cooler must of necessity use three or four separate pads and pad frames.

Evaporative coolers made from sheet metal are made of a plurality of individual pieces or elements fastened together as by welding, crimping, or the like, and by the use of fasteners such as screws, bolts, etc. The apparatus of the present invention has fewer separate pieces due to its molded fabrication and accordingly may be secured together in a far simpler manner.

SUMMARY OF THE INVENTION

The apparatus of the present invention comprises a circular or cylindrical evaporative cooling apparatus including a bottom or base portion having an integral water sump and having a support pedestal to which a blower is connected, a pad frame comprising a pair of open weave elements between which pad material is disposed, and a top which fits on the pad frame and which includes an integral trough to which water is fed from the water sump and which has a plurality of holes through which the water falls to saturate the pads.

Among the objects of the present invention are the following:

To provide new and useful evaporative cooling apparatus;

To provide new and useful round evaporative cooling apparatus;

To provide new and useful evaporative air cooling apparatus having a base, a pair of pad supports, and a top supported by the pad frames; and To provide new and useful evaporative cooler apparatus having a circular, cylindrical configuration and being made of resin impregnated material which renders the apparatus impervious to rust, corrosion, and the like.

BRIEF DESCRIPTION OF THE DRAWING

FIG. 2A and FIG. 2B are exploded, perspective views of the elements included in the apparatus of the present invention.

FIG. 3 is a top view of a portion of the apparatus of the present invention.

FIG. 4 is a perspective view of a portion of the apparatus of the present invention.

FIG. 5 is a side view of the apparatus of FIG. 4, taken generally along line 5—5 of FIG. 4.

FIG. 6 is a view in partial section of a portion of the apparatus of the present invention, taken generally along line 6—6 of FIG. 2A.

FIG. 7 is a view in partial section of a portion of the apparatus of the present invention taken generally along line 7—7 of FIG. 2B.

FIG. 8 is a view in partial section of a portion of the apparatus of the present invention taken generally along line 8—8 of FIG. 2B.

FIG. 9 is a side view, with a portion broken away, and in partial section, of the apparatus of the present invention.

DESCRIPTION OF THE PREFERRED EMBODIMENT

Figure 1:
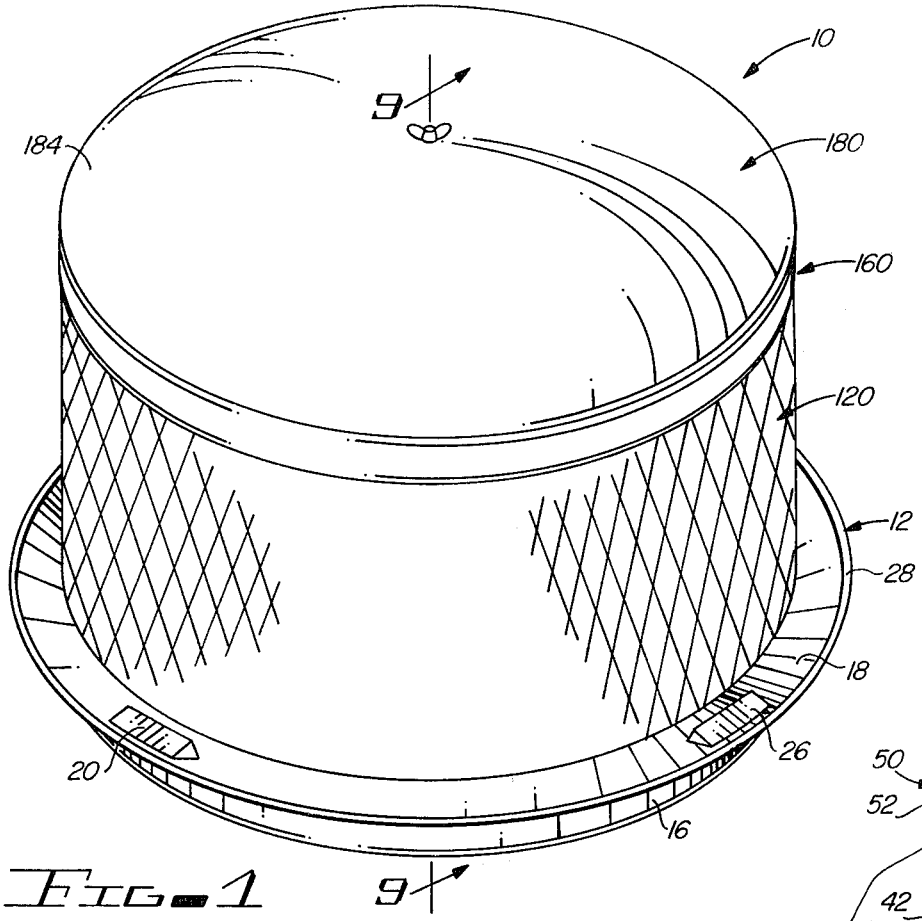
FIG. 1 is a perspective view of the apparatus of the present invention.

FIG. 1 is a perspective view of evaporative cooler apparatus 10 of the present invention. The evaporative cooler apparatus 10 is of a circular design and is preferably made of a material which is impervious to corrosion and rust, such as fiberglass impregnated with resin. As such, the solid portions of the apparatus are molded. FIGS. 2A and 2B comprise exploded views of the primary elements or portions of which the evaporative cooler apparatus 10 is comprised, namely a base 12, shown in FIG. 2B, a pad frame 120, a top element 160 and a cap 180, all of which are shown in FIG. 2A. Between the cap 180 and the top element 160 is a water distribution element or spider 90.

FIG. 3 is a top view of the pad frame 120. FIG. 4 is an enlarged perspective view of a portion of the pad frame 120, showing the two portions of the pad frame. FIG. 5 is a view in partial section of the pad frame 120 of FIG. 4, taken generally along line 5—5 of FIG. 4, showing the top portions of the pad frame 120 secured together and holding a pad between them.

FIG. 6 is an enlarged view in partial section of a portion of the top element 160 and the cap 180 disposed thereon. FIG. 6 is taken generally along line 6—6 of FIG. 2A.

FIG. 7 is an enlarged view in partial section of a portion of the base 12 taken generally along line 7—7 of FIG. 2B. FIG. 8 is an enlarged view of a portion of the base 12 taken generally along line 8—8 of FIG. 2B.

Figure 10:
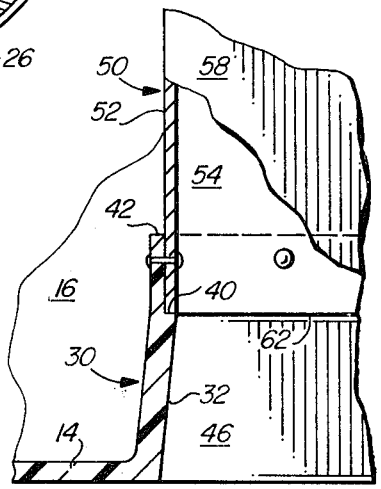
FIG. 10 is an enlarged view in partial section of a portion of the apparatus of the present invention, taken generally from circle 10 of FIG. 9.
Figure 11:
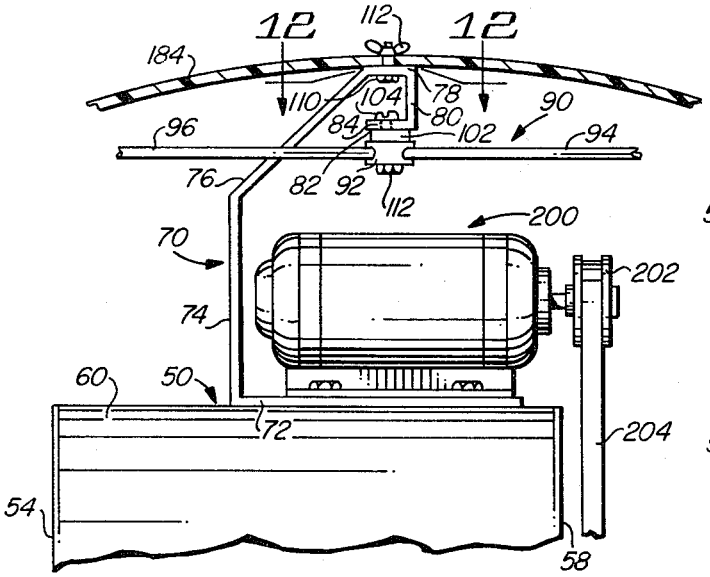
FIG. 11 is an enlarged view of a portion of the apparatus of the present invention taken generally from line 11—11 of FIG. 9.
Figure 12:
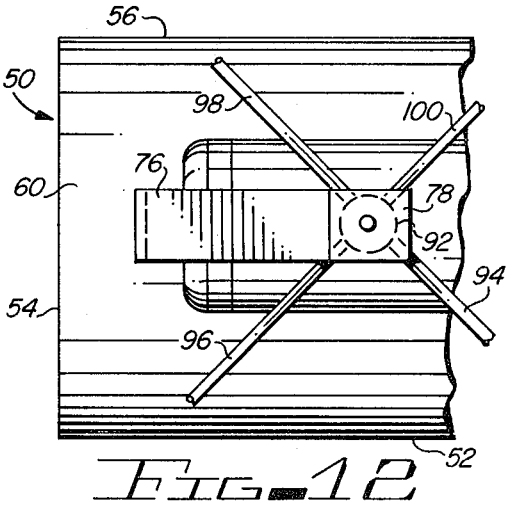
FIG. 12 is a top view of a portion of the apparatus of the present invention taken generally from line 12—12 of FIG. 11.

FIG. 9 is a side view in partial section, and partially broken away, of the assembled cooler apparatus 10. FIG. 10 is an enlarged view of a portion of the cooler apparatus 10, taken generally from circle 10 of FIG. 9. FIG. 11 is an enlarged view in partial section of a portion of the cooler apparatus 10 taken generally along line 11—11 of FIG. 9. FIG. 12 is a top view of a portion of the cooler apparatus 10 taken generally along line 12—12 of FIG. 11.

For the following descriptive material, reference will be made to FIGS. 1-12, all of the Figures, of the drawing.

The evaporative cooler apparatus 10 is generally circular in configuration, and is preferably made of resin impregnated fiberglass material. The apparatus includes a base 12, best shown in FIG. 2B and in FIG. 9, with specific portions of the base 12 also shown in FIGS. 7, 8, and 10. The base includes a generally flat bottom 12 to which is secured a generally vertically extending circular wall 16. The circular wall 16 extends upwardly from the base 12. The vertical height of the wall 16 is relatively short, as best shown in FIG. 9.

At the top of the circular wall 16 is an outwardly flaring wall portion 18. The outwardly flaring wall portion 18 includes four integral hand holds molded into the wall 18. The hand holds are identified by reference numerals 20, 22, 24, and 26 in FIG. 2B. Hand hold 20 is also shown in FIG. 1, and hand holds 20 and 26 are shown in FIG. 1.

The hand holds 20 . . . 26 are for convenience in lifting or carrying the base 12, and the other elements associated with the base 12 which comprise the cooler apparatus 10, until the base 12 is in position on the house or the structure on which it is to be located. At such time as the base 12 is disposed in its final orientation, the existence of the integral hand holds is no longer of importance.

Extending upwardly from the outer edge of the outwardly flaring wall 18 is a relatively short vertically extending flange 28. As best shown in FIG. 9, the outwardly extending wall 18 and the vertical flange 28 terminate radially outwardly from, and above, the circular cylindrical wall 16.

Extending upwardly from the bottom 14 of the base 12, and generally centered with respect to the bottom 14, is a blower support and duct 30. The blower support and duct 30 is best shown in FIGS. 2B and 10. The blower duct 30 includes four walls which extend upwardly from the bottom 14 of the base 12 and accordingly define an aperture or opening 46 in the bottom 14 through which air flows downwardly from the cooler apparatus 10. The four walls of the blower duct 30 are identified by reference numerals 32, 34, 36, and 38 in FIG. 2B. It will be noted that the four walls 32 . . . 38 of the blower duct 30 are generally rectangular in configuration, and that there is preferably a slight inward taper of the walls upwardly from the bottom 14.

The walls 32 . . . 38 of the blower duct 30 include an inner step or lip 40, best shown in FIG. 10, which receives the bottom of a blower housing 50. The step 40 is continuous on the four walls. The step or lip 40 defines a shoulder on which the blower housing 50 is disposed for securing the housing 40 to the duct 30. The step 40 is spaced downwardly from a top rim 42 which extends around the blower duct 30 and which defines the top of the duct 30. Over all, the configuration of the top of the blower duct 30 may be rectangular or square, all in accordance with the configuration of the blower housing 50 which will be mated to the blower duct 30.

The aperture or opening 46 defined by the four walls 32 . . . 38 of the blower duct 30 is the opening through which air is blown into the house or structure on which the evaporative cooler apparatus 10 is located. The size of the opening 46 is determined by the size of the blower housing 50 which is mated, as best shown in FIGS. 9 and 10, to the blower duct 30.

The blower housing 50 includes four sides 52, 54, 56, and 58, which are generally rectangularly configured and extend vertically from a bottom 62. The bottom 62 is disposed onto the shoulder or lip 40 of the blower duct 30 as best shown in FIG. 10, and as discussed above. As further shown in FIG. 10, a plurality of appropriate fastening elements, such as rivets, or the like, are used to secure the blower housing 50 and the blower duct 30 together. The blower duct 30 may be made of fiberglass material like the base 12, or it may be made of sheet metal, as desired.

The blower housing 50 includes a curved top 60 which extends between the upper portion of the sides 54 and 58, and is appropriately connected also to the sides 52 and 56 as a continuation of them. The curvature of the top 60 is of a matching radius to a blower 210 disposed within and secured to the housing 50. The blower 210, of the squirrel cage type, is well known and understood in the art.

The walls 54 and 58 of the blower housing 50 each include a relatively large diameter aperture, such as the aperture 64 shown in FIG. 9, through which air flows into the blower housing 50 in response to rotation of the blower 210 disposed therein. The air flowing into the blower housing 50 is, of course, air that has been pulled through a pad 150 in the circular pad frame 120. The air then flows from the cooler 110 through the opening 46 into duct work in the structure on which the apparatus 10 is located, or directly into the structure, in accordance with the particular design configuration of the structure and the system with which the evaporative cooler apparatus 10 is employed.

Disposed on the top of the blower housing 50, as best shown in FIGS. 9, 11, and 12, is a bracket or frame 70. The frame 70 serves two purposes. The first purpose is to hold a water distribution element or spider 90. The second purpose is to allow for the cap 180 to be secured to the base 12. The cap 180 in turn secures top element 160 and the pad frame 120 to the base 12. The entire cooler apparatus 10 is thus secured together.

The frame 70 includes a base leg 72, shown best in FIG. 11, which is approximately secured to the top portion 60 of the blower housing 50. The frame 70 also includes a vertical leg 74 extending upwardly substantially perpendicular to the base leg 72. From the top of the vertical leg 74, an angularly or diagonally extending leg 76 extends upwardly. The diagonal leg 76 terminates in a relatively short horizontal arm 78. The cap 180 is disposed on and secured to the arm 78. The cap 180 will be discussed in more detail below. The cap 180 defines a top cover closing the top of the cooler apparatus 10.

For support purposes, a downwardly extending leg 80 is secured to the end of the horizontal arm 78 remote from the diagonal leg 76. The vertical leg 80 in turn terminates in a horizontally extending portion or arm 82 which is substantially parallel to the horizontal arm 78. The two horizontal arms 78 and 82, with their vertical leg 80, define a relatively wide U shaped element disposed on its side. The water distribution spider is disposed against and secured to the arm 82. The arm 82 includes a slot 84.

The water distribution spider 90 includes a central manifold or hub 92 to which are secured four arms 94, 96, 98, and 100. The arms 94 . . . 10 are disposed substantially perpendicular to each other, or ninety degrees apart. The arms extend radially outwardly from the central manifold or hub 92. As best shown in FIGS. 2A and 9, a water supply tube 42 is appropriately secured to the hub 92. The hub 92 is accordingly hollow, and it includes a water distribution manifold which is appropriately connected to the four hollow or tubular arms 94 . . . 100.

The hub 92 also includes a boss 102 which is tapped to receive the threaded shank of a screw 104. The shank of the screw extends into the slot 84 of the arm 82 to secure the water distribution spider or element 90 to the bracket 70 and accordingly to the base 12 through the blower housing 50. The top of the boss 102, as best shown in FIGS. 9 and 11, is disposed against the bottom of the horizontally extending arm 82 of the frame 70.

A bolt 110 extends through the arm 78 of the bracket 70 to secure the cap 180 to the bracket, and through the bracket 70 and blower housing 50 to the base 12.

The bolt 110 extends upwardly through an appropriate aperture in the horizontal arm 78, and may be permanently secured to the arm 78, if desired, for ease of installation and removal of the cap 180. The shank of the bolt 110 terminates above the horizontal arm 178 and extends through an aperture 186 in the cap 180. See FIG. 2A. As shown in FIGS. 9 and 11, a wing nut 112 is used to secure the cap 180 to the bracket 70 to the blower handle 50, and in turn to the base 12. Using wing nut 112 and the bolt 110 to secure the cap 180 to the frame 70, the cap 180 may simply and easily be removed from the base 12.

The pad frame 120 is generally of a circular, cylindrical configuration, as best shown in FIGS. 1 and 2A. The pad frame 120 includes two elements, an outer frame 122 and an inner frame 140. Both inner and outer frames 122 and 140, respectively, are preferably made of a plurality of woven fiberglass strands appropriately impregnated with the resin. The result of the stranding of both inner and outer pad frames is a very pleasing effect, aesthetically, and a very functional design with respect to maximizing the area of pad 150 exposed to the air flow. The stranded pad frame also provides structural strength for the apparatus 10.

The pad frame 120 is shown best in FIGS. 2A, 3, 4, and 5. The outer frame 122 includes a bottom strand 124 which is generally circular in configuration and which is disposed at the bottom of the frame. A top strand 128 is substantially parallel to the bottom strand 124. Between the bottom and top strands are woven the vertical strands 126 in a criss-cross configuration, as shown in FIGS. 1, 2A, 4, and 9. It will be understood that the bottom strand 124, the vertical strands 126, and the top strand 128 actually comprise a plurality of continuous discrete strands, or filaments overlying and cris-crossing each other, for strength and support, as is well known and understood in the filament winding art.

Also included in the outer pad frame 122 is an intermediate support strand 130 which is spaced upwardly a relatively short distance from the bottom strand 124. The intermediate strand 130 is circular in configuration, and is best shown in FIG. 4. Extending inwardly from the intermediate support strand 130 is a plurality of pad supports 132. The pad supports 132 extend inwardly, radially, from the support strand 130 and define, with the intermediate support strand 130, a plurality of generally triangularly shaped elements on which the cooler pad 150 is disposed. This is best shown in FIG. 5. The outer pad frame 122, including the pad supports 132, may be continuous, thus defining a cylinder having an open weave.

The inner frame 140 is substantially identical to the outer frame 122 except that it does not include an intermediate support strand and pad supports as does the outer frame 122. Rather, the inner frame 140 includes a bottom strand 142 and a top strand 146 spaced apart from each other, with a plurality of vertically woven strands 144 extending between the bottom and top strands. The configuration or pattern of the open weave of the vertically woven strands 144, which extend between the bottom strands 142 and the top strand 146, is substantially identical to the open weave pattern of the vertical strands 126 of the outer frame 122.

The primary difference between the inner frame and the outer frame, except for the pad supports 132 and the intermediate support strand 130, is in the diameter of the inner frame. In order to accommodate the pad 150, the diameter of the inner frame 140 is less by several inches than that of the outer frame 122. The inner frame 140 may be fabricated as the same diameter of the outer frame 122, and then cut vertically, or axially, to overlap itself, as shown in FIG. 2A, if desired. That is, the inner frame 140 may be fabricated on the same mold or mandrel as the outer frame 122 is fabricated on. After the resin cures, the inner frame 140 may be cut axially in order to allow it to be placed on the inside of the outer frame 122.

Upon assembly of the cooler apparatus 10, the outer frame 122 is placed in the base 12, as best shown in FIG. 9, with the outer frame 122 disposed against the inside of the wall 16 of the base 12. The pad 150 is then disposed on the pad supports 132. After the pad 150 is placed on the pad supports 132 of the outer frame 122, the inner frame 140 is then placed in the base 12 and against the pad 150.

It will be noted that the bottom strands 124 and 142 of the outer and inner frames 122 and 140, respectively, are disposed on the bottom 14 of the base 12. The pad supports 132 are spaced upwardly from the bottom 14 to provide access to the entire bottom 14 and lower inner periphery of the wall 16, as will be mentioned below. After the inner frame 140 is disposed against the pads 150, the inner frame 140 may be secured together using appropriate plastic fasteners or ties 148, as shown in FIG. 2A. The plastic fasteners or ties 148 may also extend through the pad 150 to secure the outer frame 122 and the inner frame 140 together.

The pad 150 may be a continuous length of pad cut appropriately to define a pad extending a full 360° within the pad frame 120. As is well known and understood in the art, evaporative cooler pads of the prior art have primarily been made of aspen wood. However, other types of materials are now being developed and used, in addition to the well known aspen "excelsior" type pads. As will be understood, the type of material used to make up the pad 150 is immaterial.

For convenience, and if desired, the inner frame 140 may be slightly less in height than the outer frame 122, thus simplifying the securing of the pad 150 between the outer frame 122 and the inner frame 140. The pad 150 is generally a relatively cohesive structure that does not require support over its entire surface area, both inner surface and outer surface. Accordingly, the convenience in utilizing an inner frame 140 which is slightly less in height than the outer frame 122 may be advantageous.

The open weave which characterized the pad frame 120 provides complete access of the air to the pad 150 for a full 360°. There are no corners to block the air flow, and there are no portions in the 360° circumference of the cooler that are solid for support purposes. The outer and inner frames 120 and 140, respectively, which comprise the pad frame 120, provide sufficient structural strength to support the pad 150 and also to support the top portion of the cooler apparatus 10, which includes the top element 160 and the cap 180.

The top element 160, best shown in FIGS. 2A and 6, includes a cylinder wall 162 which is generally vertical and which defines the outer perimeter of the top element 160. The cylinder wall 160 is an outer wall which is disposed about the top of the pad frame 120, as best shown in FIG. 9.

The outer cylinder wall 162 includes an upper step or lip 164 which extends circumferentially about the wall 162 and which is used as a seat for the cap 180. Adjacent to the step or lip 164, and extending inwardly from the top of the outer cylinder wall 162, is a sloping wall 166. The sloping wall 166 is connected to an integral trough 168. The cross sectional configuration of the trough 168, as best shown in FIG. 6, is U-shaped. The bottom of the trough 168 includes a plurality of holes or apertures 170 through which water flows on to the pad 150. This is best shown in FIG. 9.

Extending radially inwardly from the trough 168, and remote from the sloping wall 166, is a horizontal flange 172. The horizontal flange 172 extends inwardly for a few inches, and serves to provide structural strength to the top element 160. The center of the element 160 is open, as best shown in FIGS. 2A and 6.

For convenience in securing the arms 94 . . . 100 of the water distribution element 90 to the top 160, the inwardly extending flange 172 may include appropriate holes or apertures through which plastic ties may be inserted to secure the arms 94 . . . 100 to the top 160. A tie 106 is shown in FIG. 9 as securing the arm 98 to the flange 172 of the top element 160. The ties 106 and 148 (FIG. 2A) may be substantially identical.

Surmounting the top element 160 is the cap 180. The cap 180 includes two primary portions, a curved lower wall 182 and a dome 184. The cap 180 is concavely configured with respect to the interior of the evaporative cooler apparatus 10, and thus exteriorly convex. The curved lower wall 182 matches the outer configuration of the sloping wall 166 of the top element 160. The bottom of the cap 180, and hence the bottom of the lower curved wall 182, is disposed on the lip or shoulder 164, as best shown in FIG. 6.

The cap 180 includes an aperture 186 extending through the center of the dome 184. This is best shown in FIG. 2A. As best shown in FIG. 9, the shank of the bolt 110 extends upwardly through the aperture or hole 186, and a wing nut 112 is then placed on the shank of the bolt 110 and tightened against the dome 184 to secure the cap 180, and also the top element 160, to the base 12 through the bracket 70 and the blower housing 50. As discussed above, the blower housing 50 is appropriately secured to the base 12, and the bracket 70 is appropriately secured to the blower housing 50.

Through the use of the single fastening element comprising the bolt 110 and wing nut 112, the entire evaporative cooler apparatus 10 is appropriately secured together. By removing the wing nut 112, the cap 180 may be removed from the cooler apparatus 10, and then the interior of the cooler apparatus 10 is open and exposed for examination, maintenance, etc. The removal of the bolt 110, and any ties 106, allows the water distribution element 90 to also be removed from the apparatus, if desired. The water supply tubing 242 is easily removed or disconnected from the water distribution element 90, which may then be removed from the cooler apparatus 10 separately, if the ties, such as tie 106, are removed from the arms of the water distribution spider 90 and the flange 172 of the top 160. If desired, the top element 160 may be removed along with the water distribution spider 90 by merely leaving the ties 106 secured. Obviously, since the entire apparatus is made of fiberglass, the individual elements, as well as the entire apparatus, is relatively light. Accordingly, muscular strength is not a requirement for disassembly, or assembly, of the apparatus 10, or for performing any required maintenance thereon, such as the replacement of the pad 150.

After the entire top assembly is removed, the replacement of the pad 150 is a relatively simple task, requiring only that the inner pad frame 140 be unfastened by removing the ties 148 that are used to secure the ends of the inner pad frame 140 together, and for the removal of similar ties, not shown, which secure the inner pad frame 140 to the outer pad frame 122 for purposes of holding the pad 150 to the pad frame 120. Since a large number of such ties is not required, it is a relatively simple matter to remove them.

The removal of the inner pad frame 140 allows the removal and replacement of the pad 150 to be accomplished very easily and in a most convenient way.

In addition to the elements discussed above, there are other elements that are required for the operation of evaporative cooler apparatus 10. These elements include a motor 200, a blower 210, water supply line 220, a float valve assembly 222, an overflow pipe 230, and a pump 240. As is well known and understood, these elements cooperate with the elements previously discussed above, in detail, to provide the water for saturating the pad 150 and the supply of air which causes the air to flow inwardly through the pad frame 120 and the pad 150, into the blower housing 50, and through the duct or opening 46 into the structure in which the evaporative cooler apparatus 10 is located.

The motor 200 is appropriately secured to the top of the blower housing 50. As best shown in FIG. 11, the motor 200 is secured to the horizontal base leg 72 of the frame 70, by appropriate fasteners, such as bolts. The motor 200 is accordingly secured to the blower housing 50 through the bracket or frame 70. The motor 200 includes a pulley 202 secured to the output shaft of the motor 200. A belt 204 extends from the pulley 202 to an appropriate pulley of the blower 210, as shown in FIG. 9.

The blower 210, disposed within and secured to the blower housing 50, is preferably of the squirrel cage type, as discussed above. The rotation of the vanes of the blower 210 cause air to flow through the pad 150 from outside the evaporative cooler apparatus 210 and into the blower housing 50 through the aperture 64, shown in FIG. 9, and through another, mating and aligned, aperture on the wall 54 (not shown) opposite and parallel to the opening or aperture 64 in the wall 58. The air then flows downwardly, through the opening or duct 46, and into an appropriate distribution system, such as a ductwork, or directly into the structure.

Water for saturating the pad 150 is provided by a water supply line 220 which is secured to the circular cylindrical wall 16 of the base 12. Control of the water from the water supply line 220 is through a float and valve assembly 222. The float and valve assembly 222 is, of course, appropriately connected to the supply line 220, through the wall 16. In operation, water flows into the base 12 until it reaches a predetermined height. The float and valve assembly 222 maintains the height of the water in the base 12 at a relatively constant level. If, for some reason, there is a malfunction in the float and valve assembly 222, excess water flowing into the base 12 is carried safely out of the evaporative cooler apparatus 10 through a standpipe or overflow pipe 230. The overflow pipe 230 is appropriately secured to an aperture or opening in the bottom 14 of the base 12. The overflow pipe 230 may, if desired, be connected to a hose, or the like, to remove the excess water to a desired location.

A pump 240 is used to convey the water from the base 12 through the tubing 242 to the water distribution spider 90. From the four arms 94 . . . 100 of the water distribution spider 90, water flows to the trough 168. The trough 168 is circular, extending for a full 360°, and the water flows around the trough 168 through its plurality of holes or apertures 170 to saturate the pad 150. Excess water dripping from the bottom of the pad 150 returns to the base 12 after flowing downwardly through the pad 150. As will be understood, the cooler apparatus 10 should preferably be relatively level in order to evenly saturate the pad 150 from the trough 168.

Since the motor 200 and the pump 240 require electrical connections, appropriate conductors extend to the evaporative cooler 10.

It will be noted, in FIG. 9, that the pad supports 132 of the outer frame 122 are disposed above the float and valve assembly 222. The bottom of the pad 150, which rests on the pad supports 132, is thus kept above the normal height of the water. The top of the standpipe 230 is slightly below the pad supports 132 to prevent the pad from resting in the water, which may encourage or result in rot, etc. Moreover, this prevents the pad and the inner frame 140 from interfering with the operation of the float assembly 222.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Evaporative cooler apparatus, comprising, in combination:

base means, including means for containing a quantity of water;

pad frame means disposed on the base means, including an outer pad frame extending continuously for substantially three hundred sixty degrees, and an inner pad frame spaced apart from the outer pad frame and extending continuously for substantially three hundred sixty degrees;

pad means disposed between the outer pad frame and the inner pad frame and extending continuously for substantially three hundred sixty degrees;

top means disposed on the pad frame means, including a top element, a trough in the top element extending substantially three hundred sixty degrees and disposed above the pad means for receiving a flow of water, a step extending circumferentially about the trough, and a cap defining a top cover for the cooler apparatus and disposed on the circumferentially extending step;

means for providing a flow of water from the base means to the trough for saturating the pads;

blower means secured to the base means for providing a flow of air through the pad means; and means for securing the top means to the blower means for securing the top means, the pad means, the blower means, and the base means together.

2. The apparatus of claim 1 in which the base means includes a blower duct to which the blower means is secured and through which air flows from the evaporative cooler apparatus.

3. The apparatus of claim 1 in which the outer pad frame and the inner pad frame comprise cylindrical elements having an open weave through which air flows for substantially three hundred sixty degrees.

4. The apparatus of claim 1 in which a means for providing a flow of water from the base means to the trough includes a pump for providing a flow of water, a water distribution manifold for receiving the flow of water from the pump, and a plurality of water distribution arms secured to the manifold and extending to the trough for distributing the flow of water to the trough.

5. The apparatus of claim 1 in which the pad frame means further includes pad supports, and the pad means is disposed on the pad supports.

6. The apparatus of claim 5 in which the pad supports are secured to the outer pad frame.

7. The apparatus of claim 1 in which the top element includes an outer cylinder wall, and the step is on the outer cylinder wall and adapted to receive the cap, and the trough is secured to the outer cylinder wall.

8. The apparatus of claim 7 in which the top element further includes a sloping wall between the outer cylinder wall and the trough, and the cap is disposed on the step of the outer cylinder wall and is disposed against the sloping wall.

9. The apparatus of claim 8 in which the top element further includes a horizontal flange extending radially inwardly from the trough.

10. The apparatus of claim 8 in which the cap includes a lower wall disposed on the step of the cylinder wall and a convexly configured dome extending upwardly from the lower wall.

11. The apparatus of claim 1 in which the blower means includes a blower housing secured to base means and a blower disposed in the blower housing.

12. The apparatus of claim 11 in which the means for securing the top means to the blower means includes a frame secured to the blower housing, and the top means is secured to the frame.

13. The apparatus of claim 12 in which the top means includes a top element disposed on the pad frame means and a cap disposed on the top element, and the cap is secured to the frame for securing the cap, the top element, and the pad frame means to the blower housing and to the base means.

* * * * *